US005159763A

United States Patent [19]

Platsch

[11] Patent Number: 5,159,763

[45] Date of Patent: Nov. 3, 1992

[54] DRYING ELEMENTS

[76] Inventor: Hans G. Platsch, Kupferstr. 40, D-W7000 Stuttgart 80, Fed. Rep. of Germany

[21] Appl. No.: 655,442

[22] PCT Filed: May 24, 1989

[86] PCT No.: PCT/EP89/00572

§ 371 Date: Feb. 28, 1991

§ 102(e) Date: Feb. 28, 1991

[87] PCT Pub. No.: WO90/03888

PCT Pub. Date: Apr. 19, 1990

[30] Foreign Application Priority Data

Oct. 14, 1988 [DE] Fed. Rep. of Germany ..... 3835000

[51] Int. Cl.[5] ..... F26B 3/32

[52] U.S. Cl. ..... 34/41; 34/1 W; 34/4; 34/18; 34/155

[58] Field of Search ..... 34/41, 155, 156, 39, 34/4, 1 W, 1, 68, 18

[56] References Cited

U.S. PATENT DOCUMENTS

| | | | |
|---|---|---|---|
| 2,683,939 | 7/1954 | Meltzer | 34/155 |
| 3,178,831 | 4/1965 | Howlett | 34/41 |
| 3,720,002 | 3/1973 | Martin | 34/41 |
| 3,894,343 | 7/1975 | Pray et al. | 34/41 |
| 4,727,655 | 3/1988 | Jacobi, Jr. | 34/41 |
| 4,854,052 | 8/1989 | Korpela | 34/41 |
| 4,981,433 | 1/1991 | Matsumoto et al. | 34/41 |

FOREIGN PATENT DOCUMENTS

| | | |
|---|---|---|
| 0080448 | 6/1983 | European Pat. Off. . |
| 631625 | 7/1936 | Fed. Rep. of Germany . |
| 1070647 | 12/1959 | Fed. Rep. of Germany . |
| 1074056 | 1/1960 | Fed. Rep. of Germany . |
| 2731075 | 1/1979 | Fed. Rep. of Germany . |
| 895655 | 5/1962 | United Kingdom . |

*Primary Examiner*—Henry A. Bennet
*Assistant Examiner*—Denise L. F. Gromada
*Attorney, Agent, or Firm*—Fred Philpitt

[57] ABSTRACT

A drying element for use in a printer, with an electrical heating device through which blown air flows and with a blower duct which distributes the warm blown air transversely to the conveying direction of the printed products, wherein a rod-shaped infra-red radiator extends parallel to the surface of a heating tube located upstream of the blower duct and has a surface absorbing infra-red radiation, said blower duct extending parallel to the heating tube and being connected to the latter by way of a 180° -bend.

12 Claims, 4 Drawing Sheets

DRYING ELEMENTS

The invention relates to a drying element for use in a printer as well as to a drying unit composed of drying elements of this type.

A drying element according to the preamble of claim 1 is known from U.S. Pat. No. 2,683,939. In the latter, the rod-shaped heating element is a conventional heating rod, which is located inside the heating tube and is in direct contact with the blown air to be heated. An arrangement of this type is suitable for heating the blown air, if there is no need to transmit a high thermal output to the blown air. With the very high conveying speeds of the printed products, one requires large quantities of very hot blown air, in order that the printed products can be dried reliably on the short path before reaching the next printing station.

Whereas hot air drying elements are preferred for drying water varnishes, such as are used in particular as a clear varnish over the printing inks, in order to give the surface of the finished products a lustre, infra-red radiation drying elements are preferably used for drying conventional offset inks and for drying oil varnishes.

It was also already proposed (see EP-A-0080448), to use a combined radiation/hot air drying element for drying printed products. In the drying element described in EP-A-0080448, a plurality of blower ducts following each other in the conveying direction is defined by a wall folded in a zig-zag manner, whereof the points facing the conveying path are provided with blown air discharge openings, whereas infra-red radiators are located in the gaps between the undulations. The radiation emitted by the latter partly directly reaches the surface of the printed products, partly it serves for heating the wall having zig-zag undulations and receiving the blown air on the rear side.

A combined drying element of this type is suitable for use with those printing inks which respond both to radiation drying as well as hot air drying. However, if one wished to carry out exclusively hot air drying or radiation drying with a drying element of this type, as would be advantageous for certain applications, this is not possible.

Furthermore, ultraviolet radiation drying elements are used for special varnishes and printing inks, which contain pre-polymerised synthetic materials. Not solely on account of the installation of very powerful UV radiators, but also of radiation protection and of the extraction of the ozone produced by the UV-rays, UV drying requires extensive special measures, so that correspondingly equipped printers will always be used to capacity in conjunction with ultraviolet drying.

On the other hand, in the case of infra-red drying and hot air drying, a change-over would often be appropriate, if other printing supports are to be processed on a given machine. However, this change-over presently fails in that infra-red driers and blown air driers have a different space requirement: the drying of the printed products may be brought about in a very compact space with infra-red drying; on the contrary, conventional blown air driers require a great deal of space. air in large quantities, so that a blown air drying unit constructed therewith has a compact construction so that a conventional infra-red drier can be exchanged simply therefor.

This object is achieved according to the invention by a drying element described hereafter.

In the drying element according to the invention, a rod-shaped infra-red radiator is used to produce a high heat output in a very compact space. The transfer of this heat output to the blown air first of all takes place by absorption on a heating tube extending parallel to the infrared radiator. The blown air to be heated is passed through the latter. The heating tube is in turn arranged upstream of the blower duct, which delivers the heated air.

On the one hand, one thus has an effective, intensive transfer of heat between the infra-red radiator and the heating tube, which could not be achieved by blowing the air directly past the infra-red radiator. Since the entire heating of the blown air is terminated before the latter enters the blower duct, blown air having the same temperature escapes from the various outlet points of the blower duct.

If one were to undertake the production of hot air conventionally due to the fact that the blown air is guided directly past resistance wires, then one would have to provide a radiator, which must be set up separately outside the printer. One thus requires additional installation space, which is generally not available on machines which are already installed and one also has additional heat losses on the path from the point where the heat is produced to the point where it is used.

Advantageous developments of the invention are given in the Sub-claims.

A drying element, has a particularly short construction overall, since the heating tube and blower duct keep within the same transverse limits with regard to the conveying direction of the printed products.

The development of the invention according to another embodiment is an advantage on the one hand with regard to avoiding vortices in the heating tube. In addition, due to the outer surface of the heating tube of convex curvature, it is ensured that the thermal rays striking the heating tube are not reflected back into the infra-red radiator, which improves the effective flow of heat from the infra-red radiator to the heating tube.

In this case, according to another embodiment, one can once more collect the thermal rays travelling away from the convex outer surface of the heating tube, with mechanically simple means and use them for heating the air.

With the development of the invention according to another embodiment it is ensured that even those thermal rays which starting from the infra-red radiator, first of all travel past the heating tube, do reach the surface of the heating tube.

According to another embodiment, a light funnel guiding these rays to the surface of the heating tube can be formed with elements which are mechanically particularly simple to produce and have a circular cross-section.

If the centre of the circular reflector and its radius are chosen according to another embodiment so that the ends of the two light funnels located on both sides of the central plane of the element, lie opposite the infra-red radiator and taper to a point, one achieves a particularly uniform heating of the heating tube in the peripheral direction.

The development of the invention according to another embodiment is an advantage with regard to the supply to the heating tube of those thermal rays which are emitted by the infrared radiator in the hemisphere remote from the heating tube.

The development of the invention according to another embodiment is an advantage with regard to the supply of large quantities of heat to the heating tube, in the case of a compact construction of the drying element. Even the electrical installation and maintenance of the drying element is simplified by the use of a duplex infra-red radiator.

For cooling the electrical connections and retaining devices associated with the infra-red radiator, it is generally necessary to maintain a limited cooling airstream at the infra-red radiator. With the development of the invention according to another embodiment, this cooling airstream is obtained very easily and without an additional fan, in a mechanically very simple manner due to the fact that the reflector is part of a cooling air housing surrounding the infra-red radiator, which cooling air housing is connected to the outlet of the blower duct in the manner of a water-jet pump.

As a rule, for reasons of cost it is not possible to construct the inner surface of the reflector to be genuinely reflective, for example to polish it and to provide it with a surface coating. A highly reflective surface would be desirable in itself in order to bring the greatest possible proportion of the thermal radiation produced by the infrared radiator to the outer surface of the heating tube, where it is then absorbed. However, if a secondary airstream is allowed to flow past the reflector and if this secondary airstream, which is heated by the reflector, is mixed with the main blown airstream, then the quantity of heat received by the reflector is also made use of. This additional effect is achieved both in a drying element according to claim 10 as well as to an increased extent in a drying element according to another embodiment. In this case, even in the drying element according to this embodiment, the production of the secondary airstream takes place according to the principle of a water-jet pump without an additional fan. The development of the invention according to this embodiment also has the further advantage that the outer housing is already at a lower temperature, which is an advantage with regard to protection against accidents.

The development of the invention according to another embodiment is an advantage with regard to the most excellent and effective entrainment effect of secondary air, since the "water-jet pump action" is better for defined, rapid jets of air having a small cross-section than for slow curtains of air having a large cross-section.

A drying unit, as described in another embodiment, can be exchanged simply for an infra-red drying unit provided in an identical, standard insertion frame. This makes it possible, with low change-over times, to work optionally with infra-red drying and blown air drying in one and the same printer.

The invention will be described in detail hereafter by means of embodiments, with reference to the drawings, in which.

Figure 1:
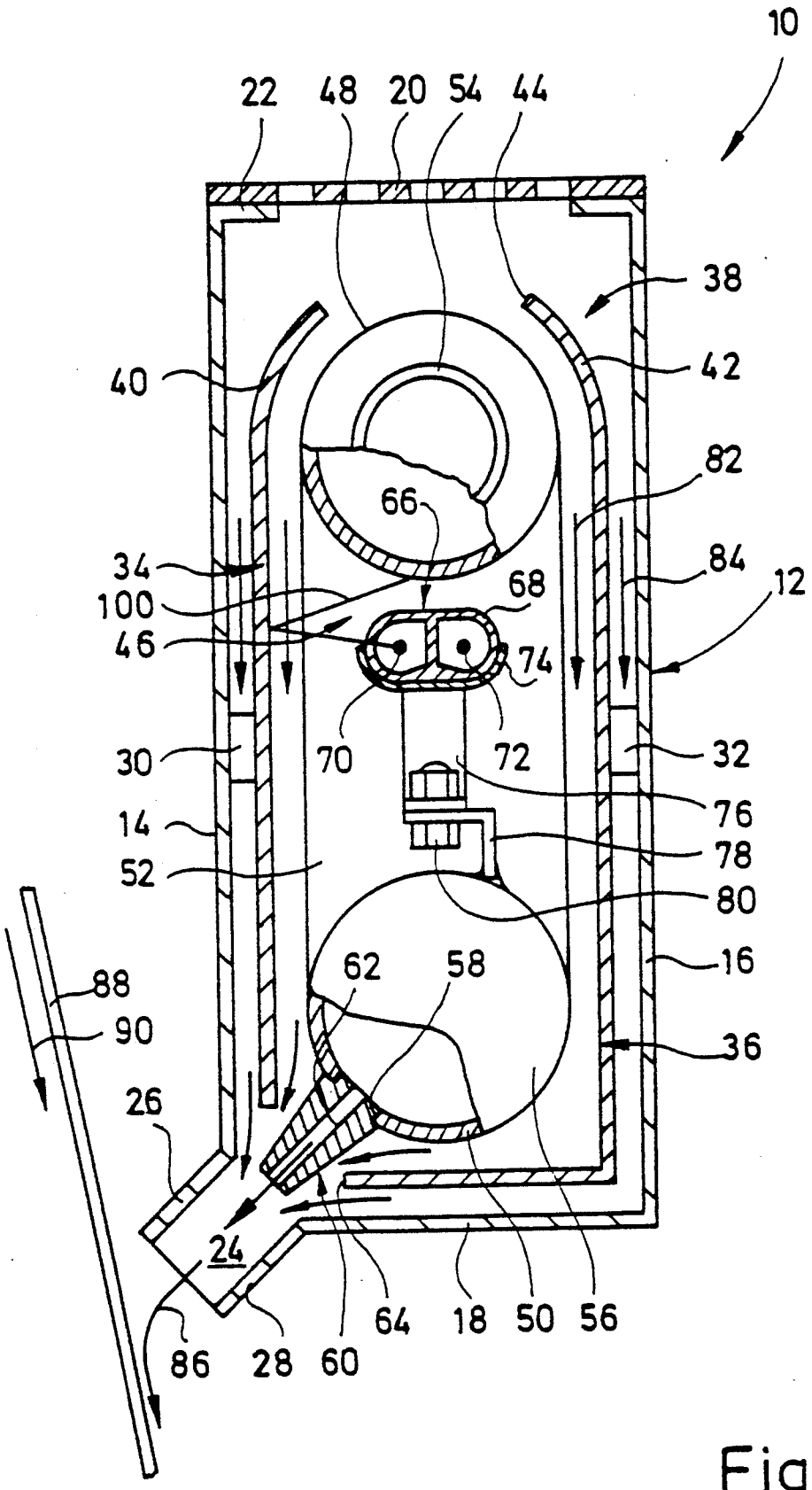
FIG. 1 is a transverse cross-section through a drying element of a blown air drying unit for an offset printing machine.

FIG. 1 shows a drying element designated generally by the reference numeral 10, which has an external housing designated generally by the reference numeral 12. The external housing 12 is defined by side walls 14, 16, a bottom wall 18 as well as a grid 20, which is placed on bent support sections 22 of the side walls 14, 16. The walls 14 to 18 have large dimensions, seen perpendicularly to the plane of the drawing.

Provided at the end of the external housing 12, which is at the bottom on the left in FIG. 1, is an elongated discharge channel 24 for hot air, which is defined by bent wall sections 26, 28 of the side wall 14 and of the bottom wall 18.

By way of arms 30, 32, the side walls 14, 16 support reflector walls 34, 36, which together define an internal housing designated generally by the reference numeral 38. The latter extends at a distance from the external housing 12 so that secondary air channels are produced between the two housings.

As can be seen from FIG. 1, a horizontal base section is integrally formed on the reflector wall 36 and the lower ends of the reflector walls 34, 36 terminate substantially as an extension of the discharge channel 24. Upper wall sections 40, 42 of the reflector walls 34, 36 are in the shape of circular arcs. Their free edges define a cooling air inlet opening 44 of the internal housing 38, which is located at a distance behind the grid 20.

A heating/nozzle unit designated generally by the reference numeral 46 is provided in the internal housing 38. Belonging to this heating/nozzle unit is a heating tube 48 extending perpendicularly to the plane of the drawing of FIG. 1, a nozzle tube 50 extending parallel to and at a distance below the heating tube 48 and a 180°-bend 52 having the same cross-section, which connects the ends of the heating tube 48 and nozzle tube 50 located behind the plane of the drawing.

The end of the heating tube 48 located at the front in FIG. 1 supports a connection 54, which can be connected to the front side of a fan (not shown), for example by a flexible hose. The end of the nozzle tube 50 located at the front in FIG. 1, is closed by an end wall 56.

Provided on a surface line, which aligns with the axis of the discharge channel 24, in the peripheral wall of the nozzle tube 50, are successive openings 58 at a distance apart, in which nozzle bodies 60 are inserted. The latter each have a nozzle bore 62, which is aligned with the central plane of the discharge channel 24.

As can be seen from FIG. 1, the nozzle body 60 extends at a distance through the slot 64 defined by the free edges of the lower ends of the reflector walls 34, 36, as far as the beginning of the discharge channel 24. The nozzle body 60 is thus at a distance from the left-hand end of the base wall 18 and from the lower end of the side wall 14.

A duplex infra-red radiator 66, designated generally by the reference numeral 66, is located in the space lying between the sides of the U-shaped heating/nozzle unit. This duplex infra-red radiator 66 has a transparent housing 68 consisting of quartz glass, in which two heating coils 70, 72 are located. The infra-red radiator 76 extends over the entire length of the heating tube 48 and indeed at a relatively short distance from the lowest point of the heating tube 48.

The half of the outer surface of the housing 68 remote from the heating tube 48 is provided with a reflective coating 74, which in practice may be a layer of gold applied by evaporation coating.

The ends of the infra-red radiator 66 are held by angle supports 76, which are in turn screwed to angle brackets 78 welded securely to the upper side of the nozzle tube 50, as shown at 80.

The above-described drying element operates in the following manner:

The air supplied to the connection 54 is forced through the heating tube 48. The thermal rays emitted by the infrared radiator 66 are absorbed by the outer surface of the heating tube 48, so that the heating tube 48 is heated generally to a high temperature. The heating tube 48 transmits heat to the air which is forced therethrough and the hot air passes by way of the 180°-bend 52 into the nozzle tube 50. From there, the heated air is discharged through the nozzle body 60 to the discharge channel 24. This discharge of heated air takes place in the form of defined jets. On account of the sudden increased in the cross-section of the jet at the discharge end of the nozzle body 60, a reduced pressure is obtained at this point. Due to this, on the one hand, air is drawn through the inside of the internal housing 38, as indicated by the arrows 82. In addition, air is sucked in through the secondary air channels, as indicated by the arrows 84.

Secondary air thus flows on both sides around the reflector walls 34, 36, on which part of the radiation emitted by the infra-red radiator 66 likewise falls, and these walls are consequently cooled. The secondary air pre-heated in this way, which is sucked in by way of the grid 20, is mixed in the discharge channel 24 with the very hot air, which has flowed through the heating tube 48. As a whole, one thus obtains a large volume of warm blown air 86, which escapes from the discharge channel 24 in the form of a curtain and encounters a printed sheet 88 obliquely, which sheet moves in the direction of arrow 90. The hot curtain of blown air dries layers of ink and varnish on the printed sheet 88.

In practice, the infra-red radiator 66 may have an output of 3.5 kW and per hour may heat a quantity of air of 60 to 100 $m^3$ to approximately 140° C. By mixing with approximately half the quantity of secondary air, one then obtains blown air having a temperature of approximately 100° C., as is desirable for drying water varnishes.

The relationship between the radiated energy received by the heating tube 48 and the radiated energy received by the reflector walls 34, 36 can be determined by way of the surface nature of these elements: if the inner surface of the reflector walls 35, 36 is highly reflective, but the surface of the heating tube 48 absorbs radiation well, then the heat supplied by the infra-red radiator 66 passes mainly to the air flowing through the heating tube 48. If the reflection capacity of the reflector walls 34, 36 is reduced, an increasing proportion of the radiated energy will be transmitted by way of the reflector walls 34, 36 to the secondary airstream 82, 84.

Figure 2:
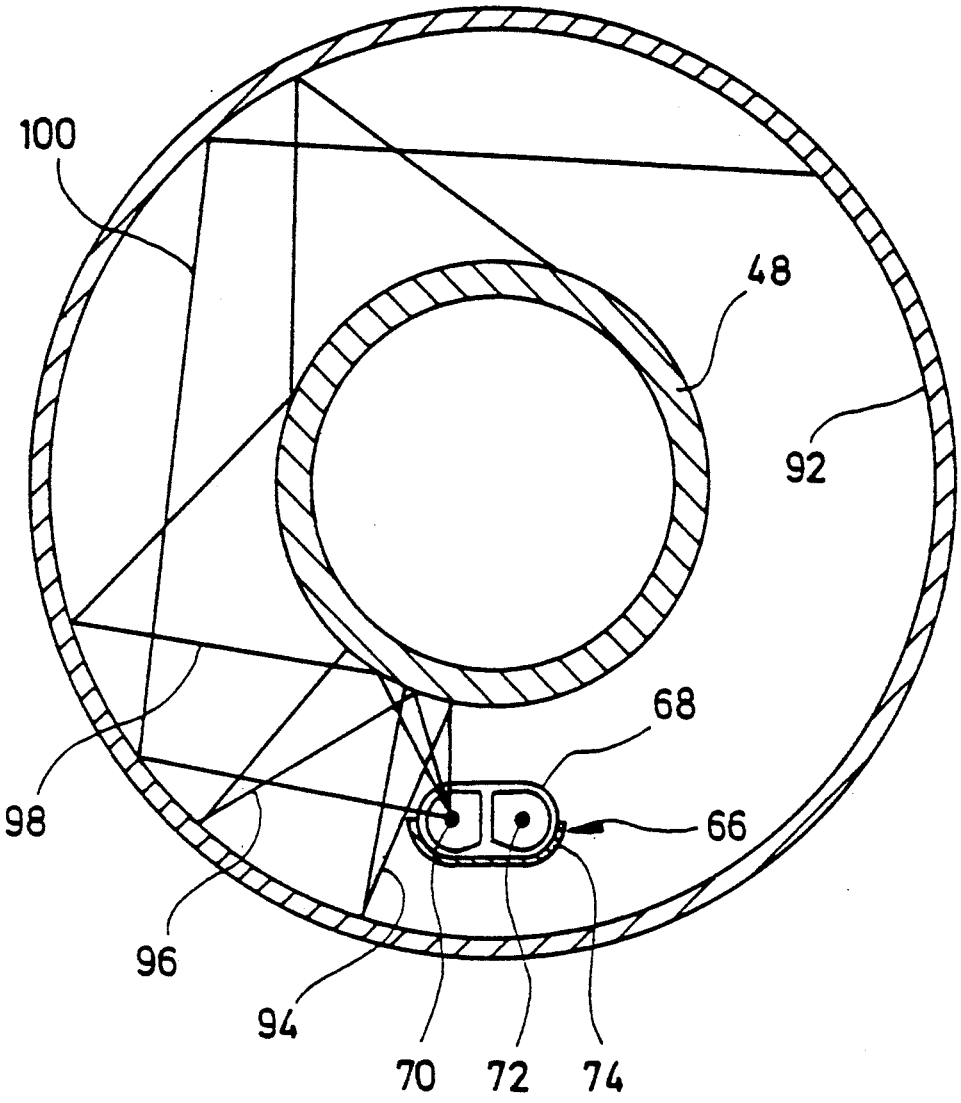
FIG. 2 is a schematic illustration, to an enlarged scale, by which the transmission of heat from the infra-red radiator to the heating tube of the drying element of FIG. 1 is illustrated.

FIG. 2 shows to an enlarged scale the path of some selected rays, which emanate from the heating coil 70. For the sake of simplification, it is assumed that only one single cylindrical reflector 92 is provided, which surrounds the heating tube 48 coaxially. In this arrangement, it will be seen that rays, which leave the heating coil 70 inclined by an angle of up to approximately 45° to the vertical, are reflected by the surface of the heating tube 48 (incomplete absorption of the rays assumed). Rays of this type, which then after reflection on the inner surface of the reflector 92, strike the outer surface of the heating tube 48 a second time, bear the reference numerals 94, 96 and 98.

It can be seen that these rays no longer reach the infra-red radiator 66 even after reflection on the surface of the heating tube 48.

Rays, which leave the heating coil 70 inclined at an angle of more than 45° with respect to the vertical, for example the ray 100, clearly do not reach the surface of the heating tube 48, on the contrary they are reflected many times on the inner surface of the cylindrical reflector 92.

In the case of a cylindrical reflector arrangement surrounding the heating tube 48, part of the output of the infra-red radiator 66 is transmitted to the reflector walls 34, 36 for geometry-related reasons.

In the embodiment according to FIG. 1, this effect is weakened due to the fact that the reflector is cylindrical solely above the centre line of the heating tube 48, on the other hand it is flat below the centre line. In this way it is ensured that even the rays emitted by the heating coils inclined by an angle of more than 45° with respect to the vertical reach the outer surface of the heating tube 48, as the ray 100 likewise indicated at this point shows.

Figure 3:
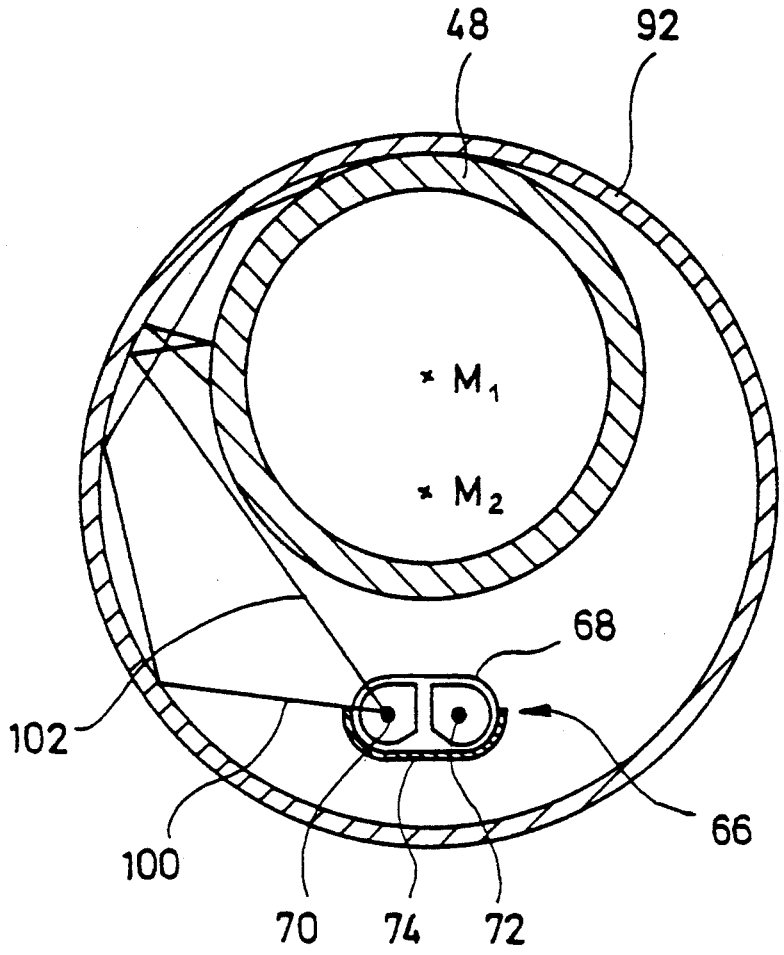
FIG. 3 is a schematic illustration similar to FIG. 2, which is valid for a modified drying element.

For the same purpose, when using a cylindrical reflector, one may place the reflector axis parallel to and at a distance from the heating tube axis, as shown in FIG. 3. In this case, the reference $M_1$ designates the heating tube axis, $M_2$ the reflector axis. One thus obtains on both sides of the vertical centre line of the drying element, two light funnels tapering in the form of a sickle, which guide the ray 100 and also a ray 102, which just borders upon the outer surface of the heating tube 48, towards the outer surface of the heating tube 48. It will be seen that the rays located therebetween, which represent approximately the same thermal output as the rays located between the vertical and the ray 102, as a whole just reach approximately the upper half of the heating tube 48. In the arrangement illustrated in FIG. 3, one thus has a heating of the heating tube 48 which is thoroughly uniform in the peripheral direction.

Figure 4:
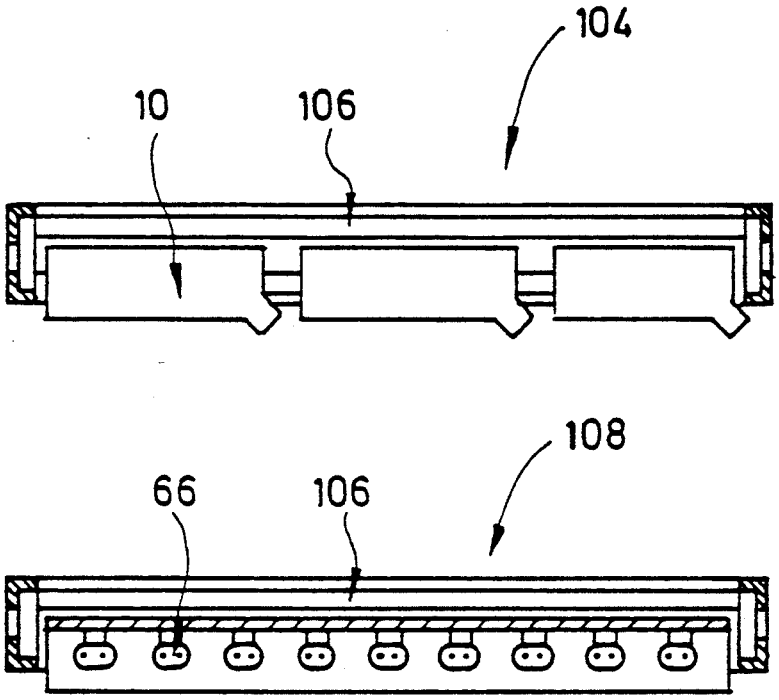
FIG. 4 is a view of a blown air drying unit constructed from drying elements according to FIG. 1 as well as of an infra-red drying unit, which has the same external geometry.

FIG. 4 shows a blown air drying unit designated generally by the reference numeral 104, with a frame 106 composed of angle sections, which support several drying elements 10.

An infra-red drying unit designated generally by the reference numeral 108 supports a plurality of infra-red radiators 66 on an identical frame 106.

It will be seen that the two types of drying unit can be exchanged quickly and easily for each other on a printer.

I claim:

1. Drying element for use in a printer, with an electrical heating device through which blown air flows and with a blower duct which distributes the warm blown air transversely to the conveying direction of the printed products, characterized in that a rod-shaped infra-red radiator (66) extends parallel to the surface of a heating tube (48), which is located upstream of the blower duct (50, 60) and has a surface absorbing infra-red radiation, said blower duct (50, 60) extending parallel to the heating tube (48) and being connected to the latter by way of a 180°-bend (52).

2. Drying element according to claim 1, characterised in that the heating tube (48) has a circular cross-section.

3. Drying element according to claim 2, characterised in that associated with the heating tube (48) is a reflector (34, 36; 92) surrounding it at least partly.

4. Drying element according to claim 3, characterised in that the distance of the reflector (92) from the heating tube (48) decreases as the distance from the infra-red radiator (66) increases.

5. Drying element according to claim 4, characterised in that the reflector (92) has a circular cross-section and the reflector axis ($M_2$) extends at a distance from and parallel to the heating tube axis ($M_1$).

6. Drying element according to claim 5, characterised in that the inner surface of the reflector (92) is in contact with the heating tube (48) on the surface lying opposite the infra-red radiator (66).

7. Drying element according to claim 1, characterised in that the infra-red radiator comprises heating coils (70, 72) located in a quartz glass housing (68) and silver-coating (74) is provided on the quartz glass housing in the part remote from the heating tube (48).

8. Drying element according to claim 1, characterised in that the infra-red radiator (66) is a duplex radiator with two heating coils (70, 72) located at a short distance from each other in comparison with the diameter of the heating tube (48).

9. Drying element according to claim 1, characterised in that the reflector (34, 36) is part of an internal housing (38), which on a section remote from the infra-red radiator (66) comprises an outlet slot (64), which is connected to a blown air discharge channel (24) and that the internal housing (38) comprises a suction opening (44) for cooling air in a section adjacent the heating tube (48).

10. Drying element according to claim 8, characterised by an external housing (12) surrounding the internal housing (38) at a distance, which external housing comprises an inlet (20) for secondary air, which is adjacent to the section of the internal housing (38) on the reflector side, as well as an outlet, adjacent to the blower duct (50, 60), for secondary air heated by the reflector (34, 36).

11. Drying element according to claim 9, characterised in that the blower duct (50, 60) comprises separate nozzles (60) following each other at a distance apart.

12. Drier unit for use in a printer, characterised by several drying elements according to claim 1, which are supported in the same alignment, lying parallel one beside the other, by a standard insertion frame, which can be inserted in a guide of a drier frame.

* * * * *